US007007500B2

(12) United States Patent
Lee

(10) Patent No.: US 7,007,500 B2
(45) Date of Patent: Mar. 7, 2006

(54) DISPENSER OF REFRIGERATOR

(75) Inventor: Jeong-Youl Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 10/808,475

(22) Filed: Mar. 25, 2004

(65) Prior Publication Data

US 2004/0187516 A1 Sep. 30, 2004

(30) Foreign Application Priority Data

Mar. 27, 2003 (KR) ..... 10-2003-0019271

(51) Int. Cl.
*B67D 5/62* (2006.01)

(52) U.S. Cl. ..... 62/389; 222/146.6; 222/533

(58) Field of Classification Search ..... 62/389–400; 193/45; 222/146.6, 533–536
See application file for complete search history.

(56) References Cited

U.S. PATENT DOCUMENTS 1,890,461 A * 12/1932 Hamburg ..... 62/338
2,126,491 A * 8/1938 McCartha ..... 222/182
3,622,047 A * 11/1971 Oberli ..... 222/136
5,437,391 A * 8/1995 Landers et al. ..... 222/1
6,158,564 A * 12/2000 Derelanko ..... 193/2 R
6,220,313 B1 * 4/2001 Estlander ..... 141/313
6,679,082 B1 * 1/2004 Tunzi ..... 62/344

FOREIGN PATENT DOCUMENTS

EP 0 449 691 * 10/1991

* cited by examiner

*Primary Examiner*—William E. Tapolcai
(74) *Attorney, Agent, or Firm*—Birch, Stewart, Kolasch & Birch, LLP

(57) ABSTRACT

A dispenser of a refrigerator comprises a dispensing chamber recessed in one of doors for opening and closing freezing and refrigerating compartments, a chute member pivotally mounted in the dispensing chamber and connected with a water supply pipe for supplying water toward the dispensing chamber, and an operating means for rotating the chute member about a pivot axis of the chute member. Accordingly, water can be easily stored in a vessel regardless of the size of the vessel, utilization effect of an internal space of the refrigerator can be improved, and insulation effect of the refrigerator can be also improved because of an increase in a thickness for insulation of the refrigerator.

18 Claims, 9 Drawing Sheets

DISPENSER OF REFRIGERATOR

This Non-provisional application claims priority under 35 U.S.C. § 119(a) on Patent Application No(s) 10-2003-0019271 filed in Korea on Mar. 27, 2003, the entire contents of which are hereby incorporated by reference.

BACKGROUND OF THE INVENTION

1. Field of the Invention

The present invention relates to a dispenser of a refrigerator, and more particularly, to a dispenser of a refrigerator capable of easily dispensing water or ice regardless of the size of a vessel.

2. Description of the Background Art

Generally, a refrigerator is divided into a freezing compartment for storing an icemaker and freezing items and a refrigerating compartment for receiving refrigerating items. The refrigerator is provided with a refrigerating cycle for performing a refrigerating cycle such as compression, condensation, expansion, and evaporation therein. By an operation of the refrigerating cycle, inside of the refrigerator is maintained as a freezing state or a cooling state.

In such a refrigerator, a dispenser for supplying ice or water without opening a door is installed.

As shown in FIG. 1, a conventional refrigerator includes: a main body 10 in which a refrigerating compartment and a freezing compartment are separately provided; a door 20 respectively opening and closing the freezing compartment and the refrigerating compartment; a water supply pipe 30 to which water is supplied from the outside; a purifying filter 32 installed at the water supply pipe 30, for purifying supplied water; a water tank 40 in which water supplied thereto through the water supply pipe 30 is stored; an ice maker 50 disposed inside the main body 10, for making ice with the supplied water; a water supply valve 34 installed between the water tank 40 and the ice maker 50, for controlling the amount of water supplied to the water tank 40 and the ice maker 50; and a dispenser 70 installed at the door 20, for dispensing water.

As shown in FIG. 2, the dispenser 70 includes: a dispensing chamber 71 recessed in the door 20 to provide a space in which a vessel 78 for storing water is received, wherein an end of the water supply pipe 30 is disposed at an upper portion thereof; a control panel 73 installed at one side of the dispensing chamber 71 and having switches 72 for an operation of a user; and a drip tray 77 having a tray member 74 installed at the bottom of the dispensing chamber 71, supporting the vessel 78 and having a plurality of holes 75 and a receiving member 76 for receiving dripping water introduced thereto through the holes 75 of the tray member 74.

By the construction as above, when a user positions the vessel 78 in the dispensing chamber 71 and operates the switch 72, the water tank 40 is opened, and thus water is supplied through the water supply pipe 30 and then is stored in the vessel 80 in the dispensing chamber 71.

However, since the dispenser 70 of the refrigerator in accordance with the conventional art is formed such that the dispensing chamber 71 has prescribed vertical and horizontal widths, a vessel bigger than the width of the dispensing chamber 71 cannot be positioned inside the dispensing chamber 71. In order to solve this problem, the width of the dispensing chamber may be largely formed. But in this case, a storing space inside the refrigerator is reduced and as a result utilization of the internal space is limited. Besides, since a thickness of the door 20 is reduced, insulation effect of the refrigerator is deteriorated and power consumption is not also efficient.

SUMMARY OF THE INVENTION

Therefore, an object of the present invention is to provide a dispenser of a refrigerator capable of storing water in various vessels without restriction of a vertical or horizontal width of a dispensing chamber by providing a chute member rotatably installed inside a dispensing chamber at a prescribed angle, connected to a water supply pipe, for guiding water supplied thereto through the water supply pipe.

Another object of the present invention is to provide a dispenser of a refrigerator capable of storing ice in various vessels without restriction of a vertical or horizontal width of a dispensing chamber by providing a chute member rotatably installed inside a dispensing chamber at a prescribed angle, connected to an ice guiding pipe through which ice made from an ice maker is supplied thereto, for guiding ice supplied thereto through the ice guiding pipe.

To achieve these and other advantages and in accordance with the purpose of the present invention, as embodied and broadly described herein, there is provided a dispenser of a refrigerator, comprising a dispensing chamber recessed in one of doors for opening and closing freezing and refrigerating compartments; a chute member pivotally mounted in the dispensing chamber and connected with a water supply pipe for supplying water toward the dispensing chamber; and an operating means for rotating the chute member about a pivot axis of the chute member.

To achieve these and other advantages and in accordance with the purpose of the present invention, as embodied and broadly described herein, there is also provided a dispenser of a refrigerator, comprising a dispensing chamber recessed in one of doors for opening and closing freezing and refrigerating compartments; a chute member pivotally suspended in the dispensing chamber and communicated with a water supply pipe for supplying water toward the dispensing chamber and a ice guiding pipe for guiding ice from a ice maker in the freezing compartment toward the dispensing chamber; and an operating means for rotating the chute member about a pivot axis of the chute member.

To achieve these and other advantages and in accordance with the purpose of the present invention, as embodied and broadly described herein, there is provided a dispenser of a refrigerator, comprising a dispensing chamber recessed in one of doors for opening and closing freezing and refrigerating compartments; a chute member pivotally installed in the dispensing chamber and communicated with a ice guiding pipe for guiding ice from a ice maker in the freezing compartment toward the dispensing chamber; and an operating means for rotating the chute member about a pivot axis of the chute member.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

First Embodiment

Figure 1:
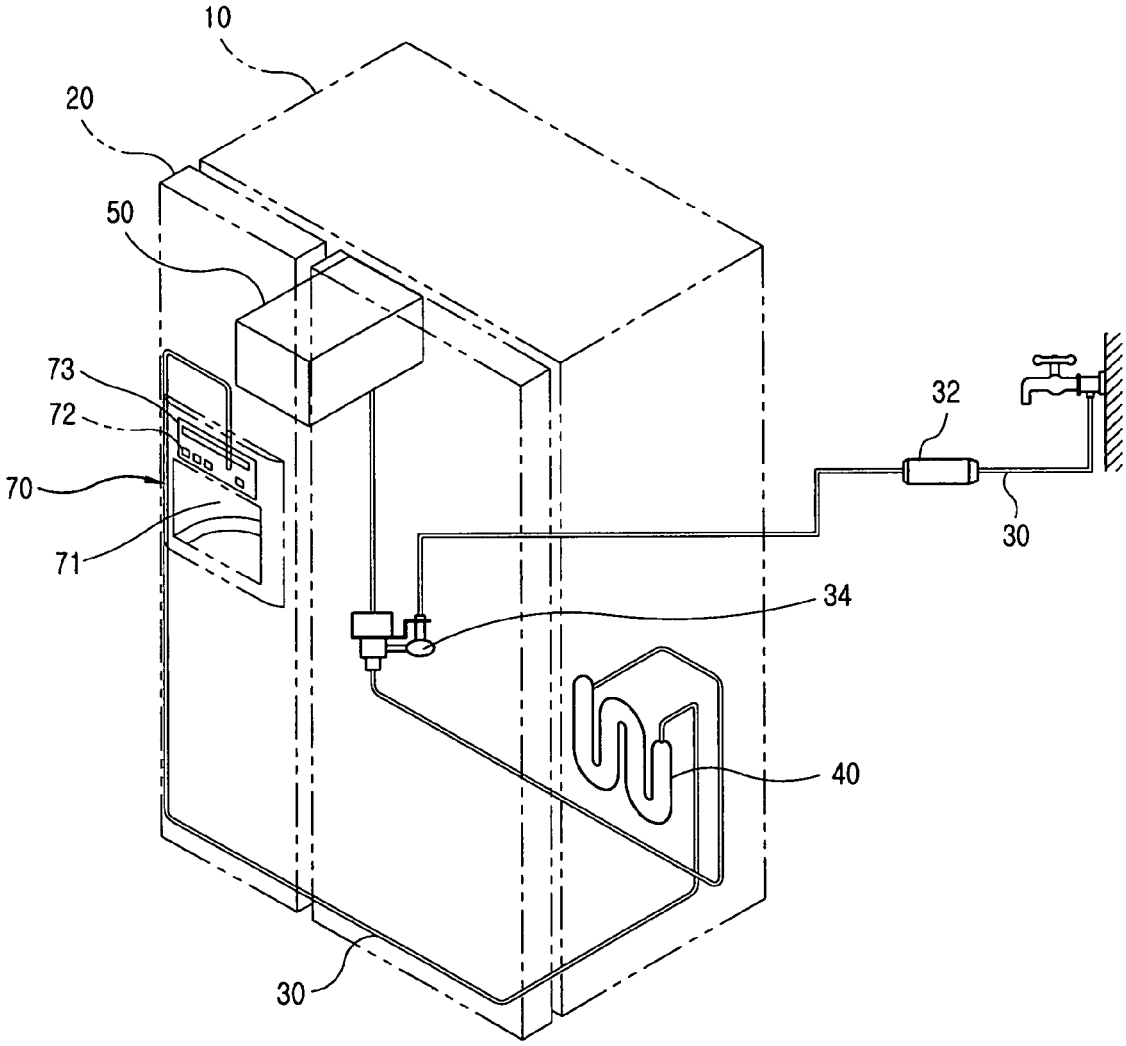
FIG. 1 CONVENTIONAL ART
FIG. 1 is a perspective view schematically showing a conventional refrigerator.
Figure 2:
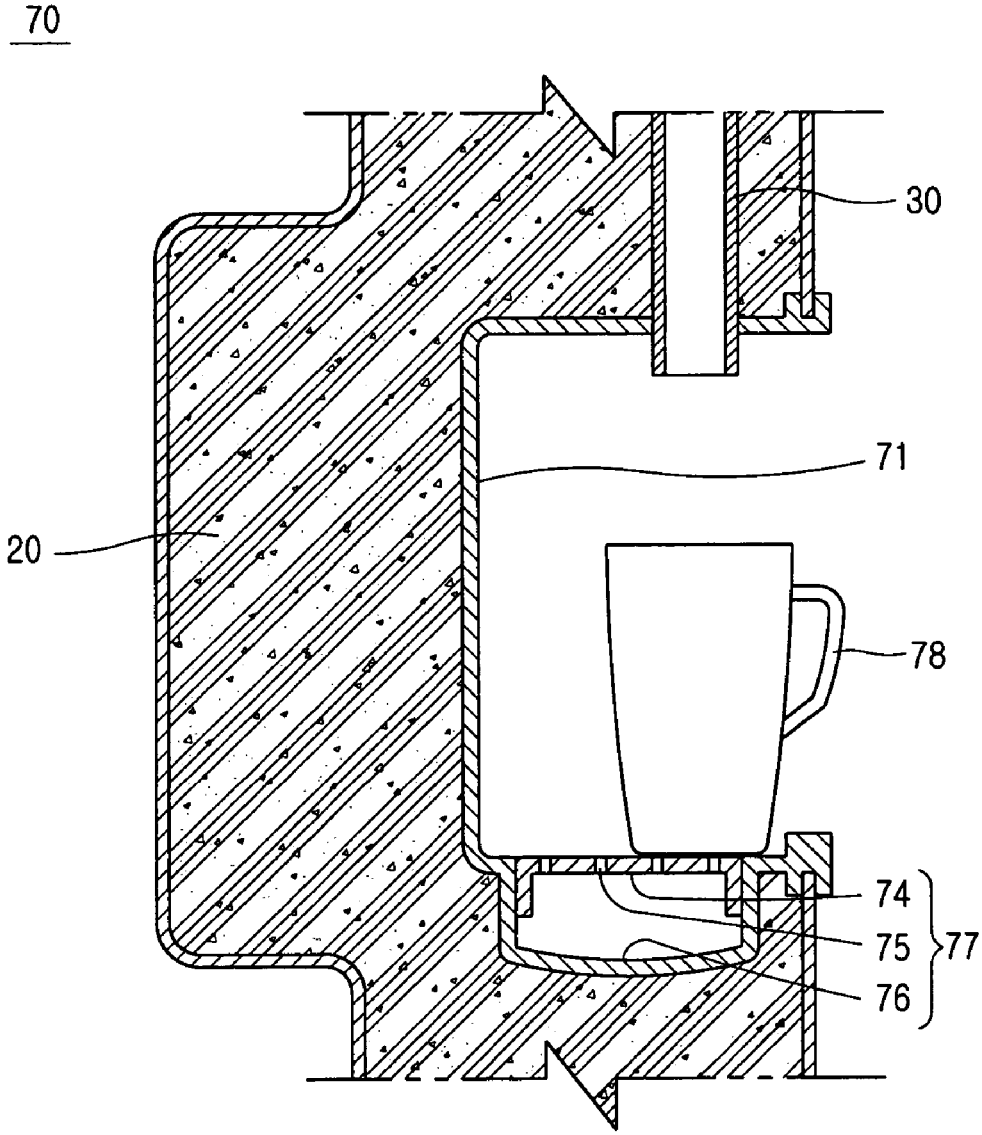
FIG. 2 CONVENTIONAL ART
FIG. 2 is a sectional view showing a dispenser of a conventional refrigerator.
Figure 3:
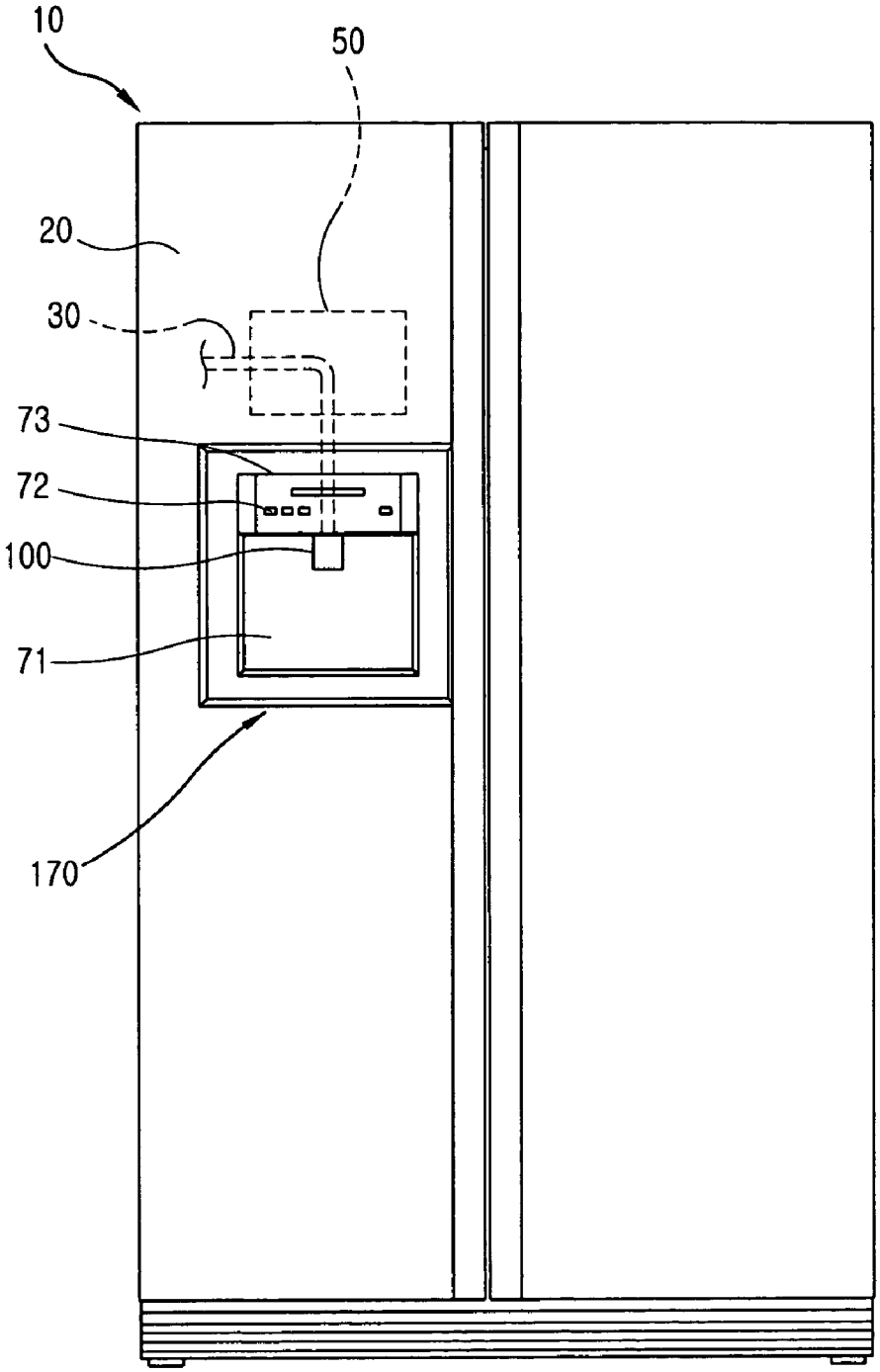
FIG. 3 is a front view showing a refrigerator in accordance with the present invention.

As shown in FIG. 3, a refrigerator in accordance with the present invention includes: a main body 10 in which a refrigerating compartment and a freezing compartment are separately provided; doors 20 respectively opening and closing the refrigerating compartment and the freezing compartment; a water supply pipe 30 through which water is supplied into the refrigerator from the outside; an ice maker 50 disposed inside the freezing compartment, for making ice with the supplied water; and a dispenser 170 installed at the door 20, for dispensing water.

Figure 4:
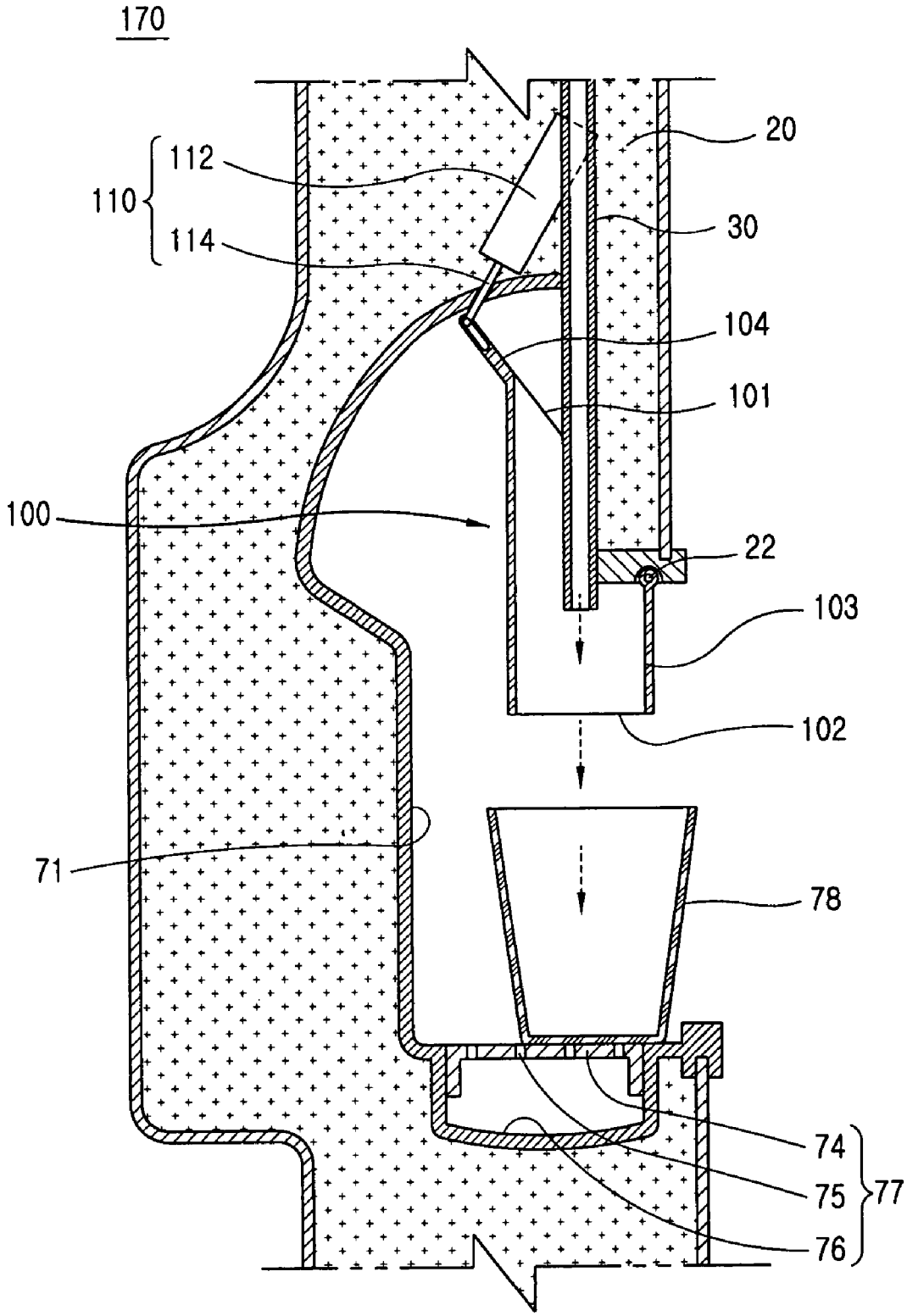
FIGS. 4 and 5 are sectional views showing a dispenser of a refrigerator in accordance with a first embodiment of the present invention and its operation state.
Figure 5:
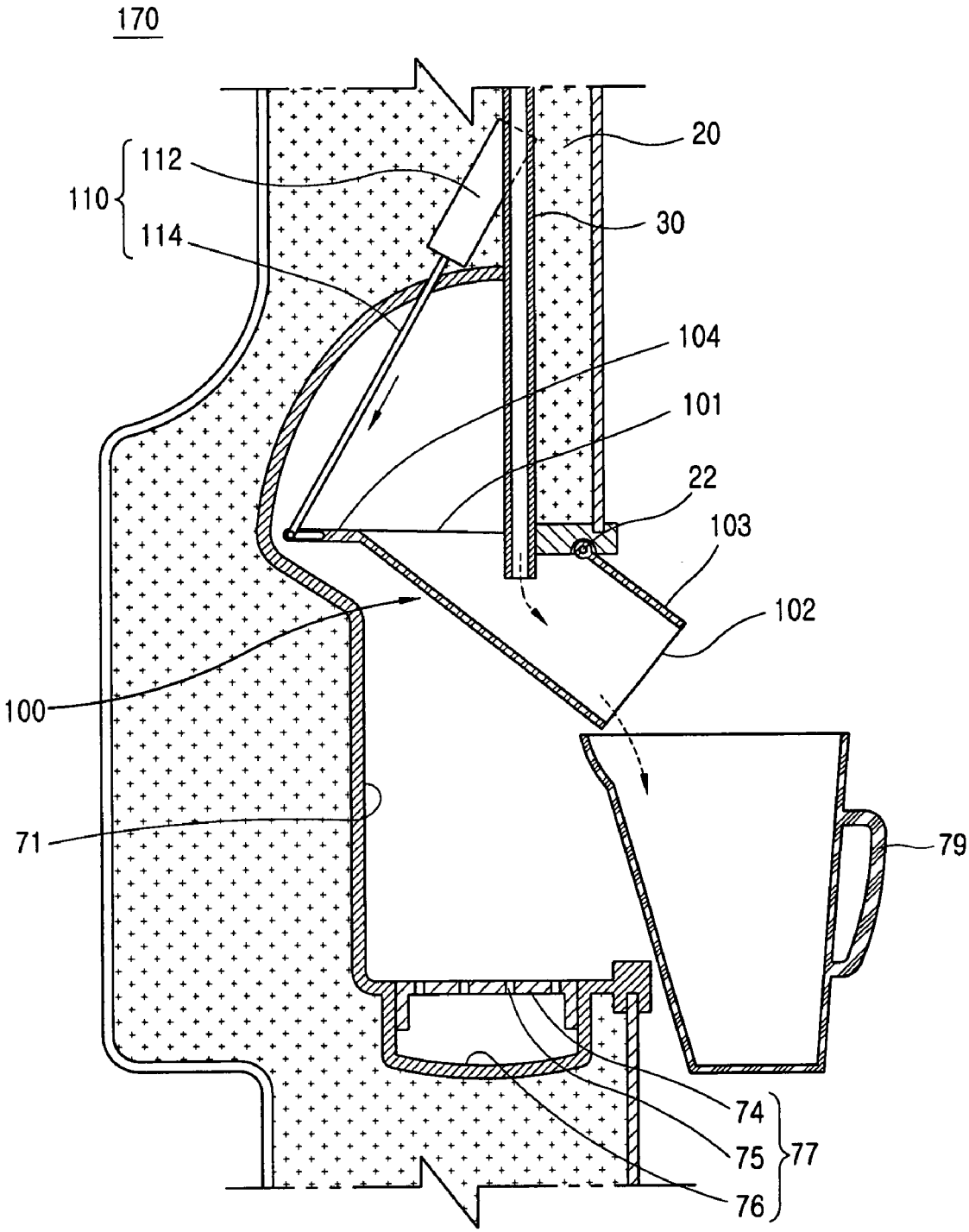

As shown in FIGS. 4 and 5, the dispenser 170 comprises a dispensing chamber 71 recessed in one of doors 20 to provide a space in which a vessel 78 for storing water is received and having an upper portion at which an end of the water supply pipe 30 is disposed; a control panel 73 installed at one side of the dispensing chamber 71 and having switches 72 for an operation of a user; a drip tray 77 having a tray member 74 installed at a bottom of the dispensing chamber 71, for supporting the vessel 78 and having a plurality of holes 75, and a receiving member 76 for receiving dripping water introduced thereto through the holes 75 of the tray member 74; a chute member 100 pivotally connected to a pivot shaft 22 provided at one side of the dispensing chamber 71, communicating with the water supply pipe 30, for guiding water supplied through the water supply pipe 30 toward the vessel 78; and an operation means 110 for rotating the chute member 100 about the pivot shaft 22.

The chute member 100 includes a water supply path 103 having an inlet 101 into which one end of the water supply pipe 30 is partially inserted so that water supplied through the water supply pipe 30 is introduced thereto and an outlet 102 through which water is discharged; and a connecting link 104 extended from one end of the water supply path 103 and connected to an operation means 110 to be explained below. The water supply path 103 of the chute member 100 is formed in a nearly cylindrical shape 103 but is not limited thereby. Thus, the water supply path 103 may be formed in a funnel shape wherein a width of the chute member 100 becomes narrower from the inlet 101 toward the outlet 102, or may be formed in a curved plate shape having a curved surface along the width.

The operation means 110 includes a piston 114 hingedly connected to one end of the connecting link 104 and linearly reciprocating to rotate the chute member 100 about the pivot shaft 22; and an actuator 112 for operating the piston 114. The actuator 112 is electrically connected to a switch 72 of the control panel 73 and is operated by an operation of the switch 72. Such an operation means 110 rotates the chute member 100 at a prescribed angle and also fixes a position of the chute member 100.

But the construction for rotating the chute member 100 is not limited by the operation means 110 in which the piston 114 and the actuator 112 are mechanically connected. For the construction, a means constructed with a mechanism of a solenoid connected to the connecting link 104, a motor connected to the pivot shaft 22 or other forms may be applied. In addition, a user may directly rotate the chute member 100 manually.

Hereinafter, an operation of the dispenser 70 of the refrigerator in accordance with the first embodiment of the present invention constructed as above will now be described.

As shown in FIG. 4, when a vessel 78 for storing water is smaller than vertical and horizontal widths of the dispensing chamber 71, the vessel 78 is positioned in the dispensing chamber 71. In case that a switch of the switches 72 corresponding to water supply control is operated, water is supplied through the water supply pipe 30. Then, water is guided to the water supply path 103 of the chute member 100 and then is stored in the vessel 78.

As shown in FIG. 5, when a vessel 79 for storing water is bigger than a vertical or horizontal width of the dispensing chamber 71, a switch of the switches 72, for controlling the operation means 110 is operated, so that the actuator 112 is operated. Accordingly, the piston 114 proceeds in order to rotate the chute member 100 about the pivot shaft 22. By the rotation of the chute member 100, the outlet 102 of the water supply path 103 faces toward the outside of the dispensing chamber 71. At this time, an inlet of the vessel 79 is positioned to be adjacent to the outlet 102 of the water supply path 103. Then, when a switch corresponding to water supply control is operated, water is supplied through the water supply pipe 3. Then, water is guided to the water supply path 103 of the chute member 100, and then water is stored in the vessel 79.

In the dispenser 170 of a refrigerator in accordance with the first embodiment of the present invention constructed and operated as above, water supplied through the water supply pipe 30 is guided thereto by the chute member 100 which is pivotally moved and then is stored in the vessel. Accordingly, even in case that the vessel is bigger than the width of the dispensing chamber 71, water can be easily stored in the vessel. Besides, since the width of the conventional dispensing chamber 71 can be remarkably reduced, utilization effect of an internal space of the refrigerator can be improved, and insulation effect of the refrigerator can be also improved because of an increase in a thickness for insulation. In addition, since water is supplied in a state that the chute member 100 is protruded outside the refrigerator, a state that the vessel is filled with water can be checked with the naked eye of a user.

Second Embodiment

A dispenser of a refrigerator in accordance with a second embodiment of the present invention will now be described with reference to FIGS. 6 and 7. The same reference numerals are given to the same parts as the above-mentioned first embodiment, and descriptions thereon will be omitted.

Figure 6:
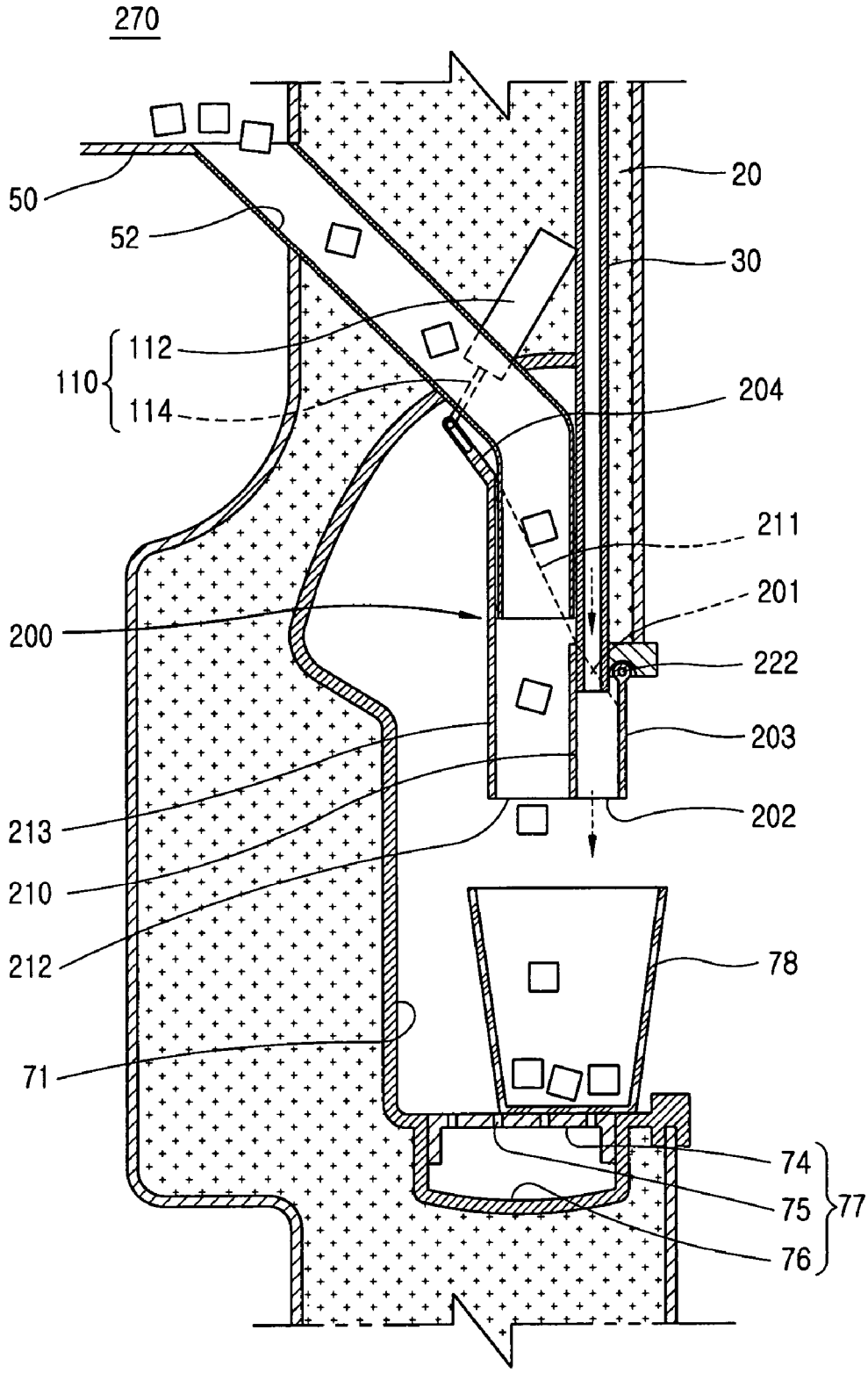
FIGS. 6 and 7 are sectional views showing a dispenser of a refrigerator in accordance with a second embodiment of the present invention and its operation state.

As shown in FIG. 6, the dispenser 270 of the refrigerator in accordance with the second embodiment of the present invention includes: a dispensing chamber 71 recessed in doors 20 to provide a space in which a vessel 78 for storing water is received and having an upper portion at which one end of a water supply pipe 30 through which water is supplied thereto and one end of an ice guiding pipe 52 for guiding ice made from an ice maker 50 are disposed; a control panel 73 installed at one side of the dispensing chamber 71 and having switches 72 for an operation of a user; a drip tray 77 having a tray member 74 installed at a bottom of the dispensing chamber 71, supporting the vessel 78 and having a plurality of holes 75 and a receiving member 76 for receiving dripping water introduced thereto through the holes 75 of the tray member 74; a chute member 200 pivotally connected to a pivot shaft 222 provided at one side of the dispensing chamber 71, communicating the water supply pipe 30 and the ice guiding pipe 62, for guiding water and ice respectively supplied thereto through the water supply pipe 30 and the ice guiding pipe 52 to the vessel 78; and an operation means 110 for rotating the chute member 200 about the pivot shaft 222.

The chute member 200 includes: a water supply path 203 having an inlet 201 into which one end of the water supply pipe 30 is partially inserted so that water supplied through the water supply pipe 30 is introduced thereto and an outlet 202 through which water is discharged; an ice guiding path 213 separated from the water supply path 203 by a partition wall 210, and having an inlet 211 into which one end of the ice guiding pipe 52 is partially inserted so that ice supplied through the ice guiding pipe 52 is introduced thereto and an output 212 through which the ice is discharged; a connecting link 204 extended from one end of the water supply path 203 or the ice guiding path 213 and connected to an operation means to be explained below.

The water supply path 203 and the ice guiding path 213 of the chute member 200 are formed in a nearly cylindrical shape but are not limited thereby. Thus, the water supply path 203 and the ice guiding path 213 of the chute member 200 may be formed in a funnel shape wherein a width of the chute member 200 becomes narrower from the inlet 201, 211 toward the outlet 202, 212, or may be formed in a curved plate shape having a curved surface along the width thereof.

The operation means 110 includes a piston 114 hingedly connected to an end of the connecting link 204 and linearly reciprocating in order to rotate the chute member 100 about the pivot shaft 222; and an actuator 112 for operating the piston 114. The actuator 112 is electrically connected to a switch 72 of the control panel 73 and is operated by an operation of the switch 72. Such an operation means 110 rotates the chute member 200 at a certain angle and also fixes a position of the chute member 200.

The construction for rotating the chute member 200 is not limited by the operation means 110 in which the piston 114 and the actuator 112 are mechanically connected. For the construction, a means constructed with a mechanism of a solenoid connected to the connecting link 204, a motor connected to the pivot shaft 222 or other forms may be applied. In addition, a user may directly rotate the chute member 200 manually.

Hereinafter, an operation of the dispenser 270 of a refrigerator in accordance with the second embodiment of the present invention constructed as above will now be described.

As shown in FIG. 6, when a vessel 78 for storing water is smaller than vertical and horizontal widths of the dispensing chamber 71, the vessel 78 is positioned in the dispensing chamber 71. In case that a switch of the switches 72, which controls water supply, is operated, a water tank is opened, and thus water is supplied through the water supply pipe 30. In addition, in case that a switch of the switches 72, which controls ice supply, is operated, the ice maker 50 is opened, and thus the ice made in the ice-maker 50 is supplied through the ice guiding pipe 52. Water or ice supplied in such a manner are guided to the water supply path 203 or the ice guiding path 213 of the chute member 200 and then stored in the vessel 78.

Figure 7:
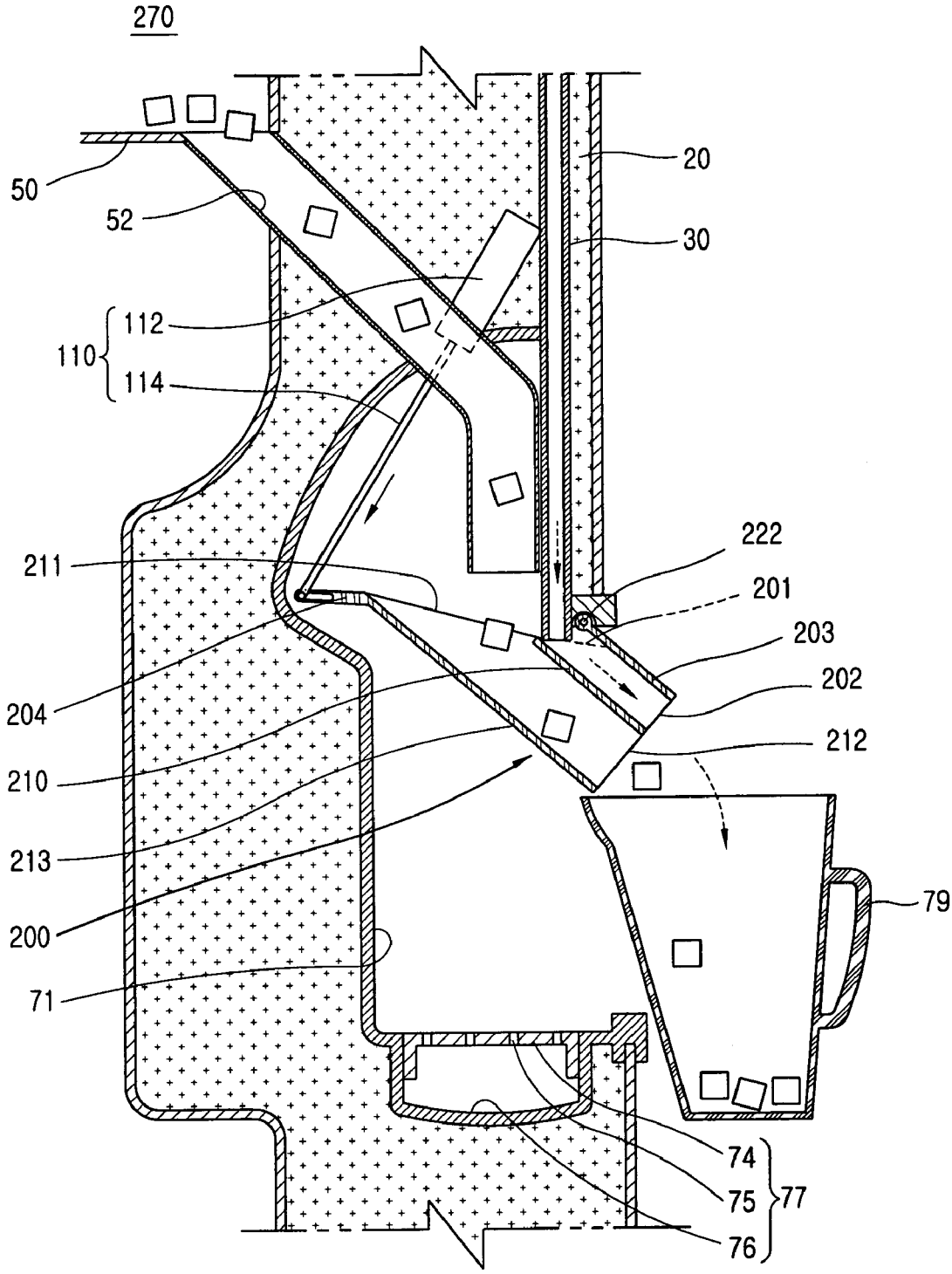

As shown in FIG. 7, when the vessel 79 for storing water is bigger than a vertical or horizontal width of the dispensing chamber 71, a switch for controlling the operation means 110 is operated. Then, the piston 114 proceeds by the operation of the actuator 112 so as to rotate the chute member 200 about the pivot shaft 222. Accordingly, the outlets 202, 212 of the water supply path 203 and the ice guiding path 213 face toward the outside of the dispersing chamber 71. At this time, an inlet of the vessel 79 is positioned to be adjacent to the outlet 202, 212, and a switch controlling water supply or ice supply is operated. Then, water or ice is supplied through the water supply pipe 30 or the ice guiding pipe 52, guided to the water supply path 203 or the ice guiding path 213 of the chute member 200 and then stored in the vessel 79.

In the dispenser 270 of the refrigerator in accordance with the second embodiment of the present invention constructed and operated as above, water or ice is guided to the chute member 200 which is pivotally moved and then is stored in a vessel for water intake. Accordingly, even in case a vessel is bigger than a width of the dispensing chamber 71, water or ice can be easily stored therein. Besides, since the width of the dispensing chamber 71 can be remarkably reduced, utilization effect of an internal space of the refrigerator can be improved, and insulation effect of the refrigerator can be also improved because of an increase in a thickness of doors. In addition, since water is supplied in a state that the chute member 200 is protruded outside the refrigerator, a state that the vessel is filled with water can be checked with the naked eye. Also, since the water supply path 203 and the ice guiding path 213 for guiding water and ice are integrally formed in the chute member 200, a construction of the dispenser 270 becomes simple, and water and ice can be easily stored in the vessel at the same time.

Third Embodiment

A dispenser of a refrigerator in accordance with a third embodiment of the present invention will now be described with reference to FIGS. 8 and 9. The same reference numerals are given to the same parts as the above-mentioned first embodiment, and descriptions thereon will be omitted.

Figure 8:
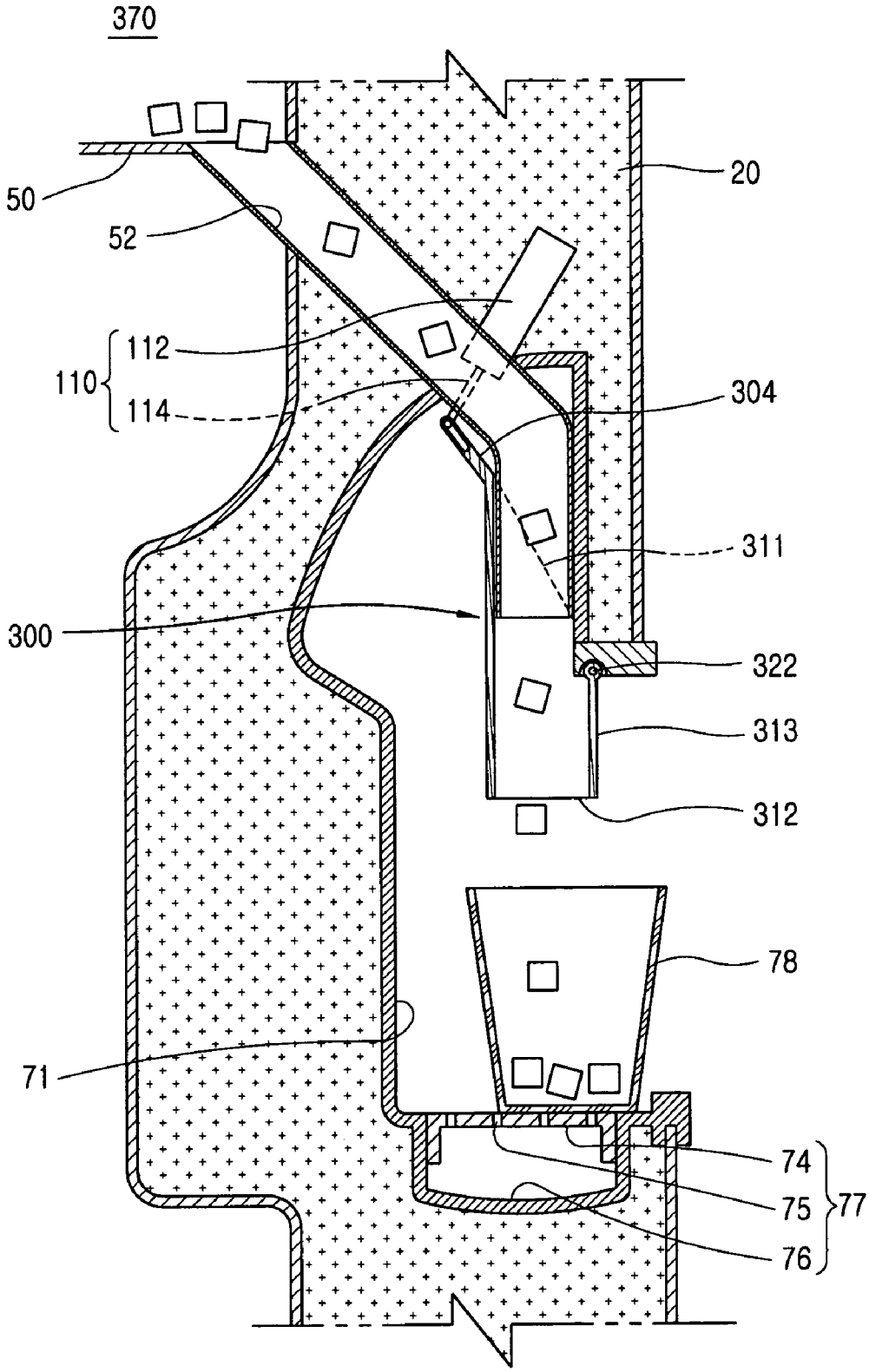
FIGS. 8 and 9 are sectional views showing a dispenser of a refrigerator in accordance with a third embodiment of the present invention and its operation state.

As shown in FIG. 8, the dispenser 370 of the refrigerator in accordance with the third embodiment of the present invention includes: a dispensing chamber 71 recessed in doors 20 to provide a space in which a vessel 78 for storing water is received and having an upper portion at which one end of an ice guiding pipe 52 for guiding ice made in an ice maker 50 is disposed; a control panel 73 installed at one side of the dispensing chamber 71 and having switches 72 for an operation of a user; a drip tray 77 having a tray member 74 installed at a bottom of the dispensing chamber 71, supporting the vessel 78 and having a plurality of holes 75, and a receiving means 76 for receiving dripping water introduced thereto through the holes 75 of the tray member 74; a chute member 300 pivotally connected to a pivot shaft 322 provided at one side of the dispensing chamber 71, communicating with the ice guiding pipe 52, for guiding ice supplied through the ice guiding pipe 52 to the vessel 78; and an operation means 110 for rotating the chute member 300 about the pivot shaft 322.

The chute member 300 includes: an ice guiding path 313 having an inlet 311 to which ice supplied through the ice guiding pipe 52 is introduced and an outlet 312 through which the ice is discharged; and a connecting link 304 extended from one end of the ice guiding pipe 313 and connected to an operation means 110 to be explained below. The ice guiding path 313 of the chute member 300 is formed in a nearly cylindrical shape but is not limited thereby. Thus, the ice guiding path 313 of the chute member 300 may be formed in a funnel shape wherein a width of the chute member 300 becomes narrower from the inlet 311 toward the outlet 312, or may be formed in a curved plate shape having a curved surface along the width thereof.

The operation means 110 includes a piston 114 hingedly connected to one end of the connecting link 304 and linearly reciprocating in order to rotate the chute member 300 about the pivot shaft 322; and an actuator 112 for operating the piston 114. The actuator 112 is electrically connected to a switch 72 of the control panel 73 and is operated by an operation of the switch 72. Such an operation means 110 rotates the chute member 300 at a certain angle and also fixes a position of the chute member 300.

The construction for rotating the chute member 300 is not limited by the operation means 110 in which the piston 114 and the actuator 112 are mechanically connected. For the construction, a means constructed with a mechanism of a solenoid connected to the connecting link 304, a motor connected to the pivot shaft 322 or other forms may be applied. In addition, a user may directly rotate the chute member 300 manually.

Herein, an operation of the dispenser 370 of the refrigerator in accordance with the third embodiment of the present invention constructed as above will now be described.

As shown in FIG. 8, when a vessel 78 for storing water is smaller than vertical and horizontal widths of the dispensing chamber 71, the vessel 78 is positioned in the dispensing chamber 71. Then, a switch of the switches 72, which controls ice supply, is operated, ice made from the ice maker 50 is supplied through the ice guiding pipe 52, guided to the ice guiding path 313 of the chute member 300 and then stored in the vessel 78.

Figure 9:
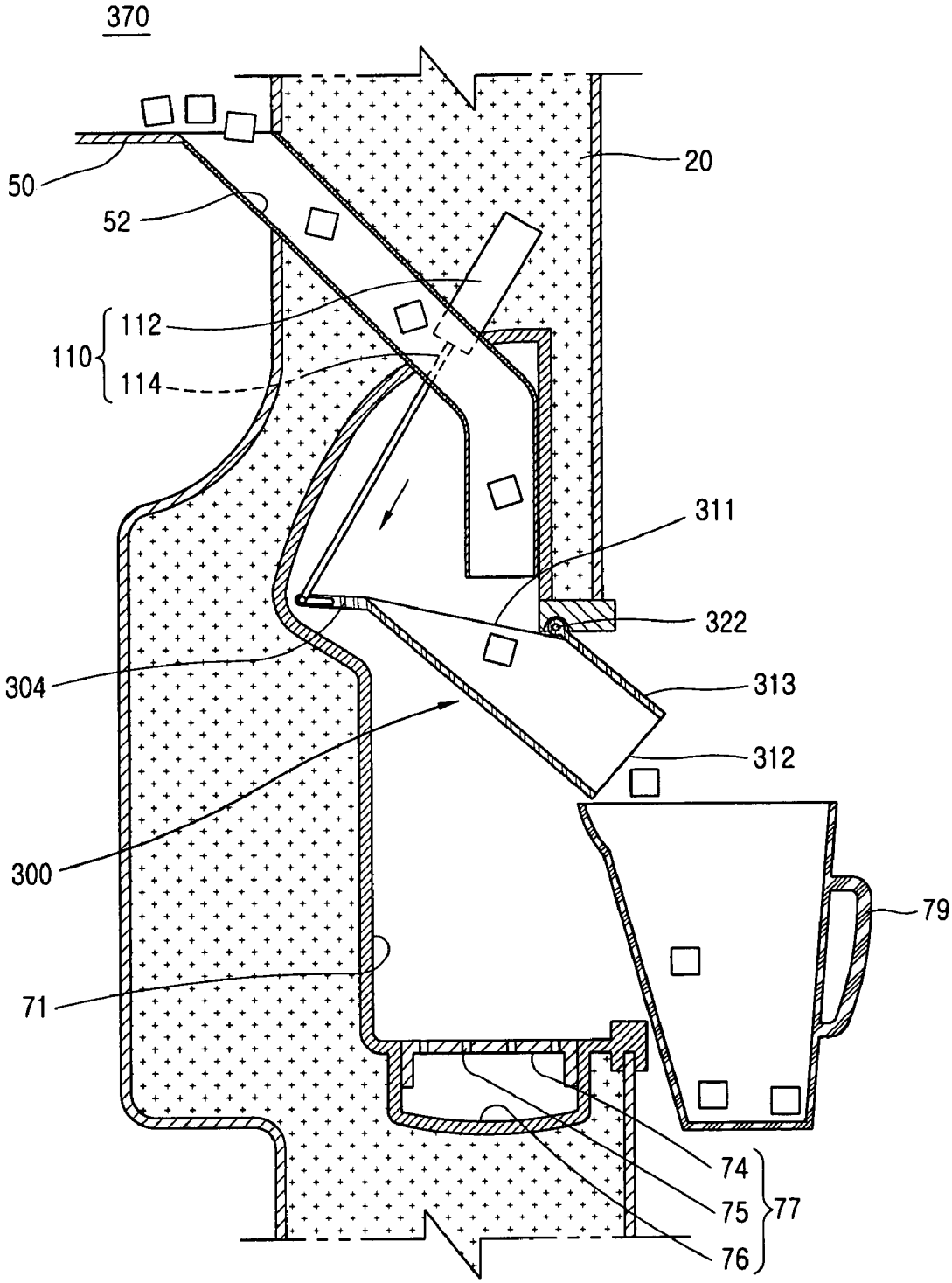

As shown in FIG. 9, when a vessel 79 for storing water is bigger than a vertical or horizontal width of the dispensing chamber 71, a switch for controlling the operation means 110 is operated. Then, by an operation of the actuator 112, the piston 114 proceeds in order to rotate the chute member 300 about the pivot shaft 322. Accordingly, an outlet 312 of the ice guiding path 313 faces to the outside of the dispersing chamber 71. At this time, an inlet of the vessel 79 is positioned to be adjacent to the outlet 312 of the ice guiding path 313, and a switch controlling ice supply is started. Then, ice is supplied through the ice guiding pipe 52, guided to the ice guiding path 313 of the chute member 300 and then stored in the vessel 79.

In the dispenser 370 of a refrigerator in accordance with the third embodiment of the present invention constructed and operated as above, ice is guided thereto by the chute member 100 which is pivotally moved, and then ice is stored in the vessel for storing water. Accordingly, even in case the vessel is bigger than the width of the dispensing chamber 71, the ice can be easily stored in the vessel. Besides, since the width of the dispensing chamber 71 can be remarkably reduced, utilization effect of an internal space of the refrigerator can be improved, and insulation effect of the refrigerator can be also improved because of an increase in a thickness for insulation.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A dispenser of a refrigerator, comprising:

a dispensing chamber recessed in one of doors for opening and closing freezing and refrigerating compartments;

a chute member pivotally mounted in the dispensing chamber and connected with a water supply pipe for supplying water toward the dispensing chamber; and an operating means for rotating the chute member about a pivot axis of the chute member.

2. The dispenser of claim 1, wherein the operating means comprises:

a connecting link extended an end of the chute member;

a piston hingedly connected to the connecting link and linearly reciprocating; and an actuator connected with the piston, for operating the piston.

3. The dispenser of claim 1, wherein the chute member comprises:

an inlet into which one end of the water supply pipe is partially inserted so that water supplied through the water supply pipe is introduced thereto; and an outlet through which water is discharged toward a vessel for storing water.

4. The dispenser of claim 3, wherein the chute member is formed in a cylindrical shape.

5. The dispenser of claim 3, wherein the chute member is formed in a funnel shape wherein a width of the inlet is larger than that of the outlet.

6. The dispenser of claim 3, wherein the chute member is formed in a curved plate shape having a curved surface along the width thereof.

7. A dispenser of a refrigerator, comprising:

a dispensing chamber recessed in one of doors for opening and closing freezing and refrigerating compartments;

a chute member pivotally suspended in the dispensing chamber and communicated with a water supply pipe for supplying water toward the dispensing chamber and a ice guiding pipe for guiding ice from a ice maker in the freezing compartment toward the dispensing chamber; and an operating means for rotating the chute member about a pivot axis of the chute member.

8. The dispenser of claim 7, wherein the chute member comprises:

a water supply path disposed in the dispensing chamber and communicating with the water supply pipe; and an ice guiding path disposed in the dispensing chamber and communicated with the ice guiding pipe.

9. The dispenser of claim 8, wherein the water supply path and the ice guiding path are integrally formed.

10. The dispenser of claim 8, wherein the water supply path and the ice guiding path are formed in a nearly cylindrical shape.

11. The dispenser of claim 7, wherein the operating means comprises:

a connecting link extended from an end of the chute member;

a piston hingedly connected to the connecting link and linearly reciprocating; and an actuator connected to the piston, for operating the piston.

12. The dispenser of claim 7, wherein a drip tray is positioned in a bottom of the dispensing chamber.

13. The dispenser of claim 12, wherein the drip tray comprises:

a tray member installed at the bottom of the dispensing chamber and having a plurality of holes;

a receiving member for receiving dripping water introduced thereto through the holes of the tray member.

14. A dispenser of a refrigerator, comprising:

a dispensing chamber recessed in one of doors for opening and closing freezing and refrigerating compartments;

a chute member pivotally installed in the dispensing chamber and communicated with a ice guiding pipe for guiding ice from a ice maker in the freezing compartment toward the dispensing chamber; and an operating means for rotating the chute member about a pivot axis of the chute member.

15. The dispenser of claim 14, wherein the operating means comprises:

a connecting link extended from an end of the chute member;

a piston hingedly connected to the connecting link and linearly reciprocating; and an actuator connected to the piston, for operating the piston.

16. The dispenser of claim 14, wherein the chute member is formed in a cylindrical shape.

17. The dispenser of claim 14, wherein the chute member is formed in a funnel shape wherein a width thereof becomes narrower from an inlet to which ice supplied through the ice guiding pipe 52 is introduced toward an outlet through which the ice is discharged to a vessel for storing ice.

18. The dispenser of claim 14, wherein the chute member is formed in a curved plate shape having a curved surface along the width thereof.

* * * * *